US006537957B1

(12) United States Patent
Cardola et al.

(10) Patent No.: US 6,537,957 B1
(45) Date of Patent: Mar. 25, 2003

(54) LIQUID ACIDIC HARD SURFACE CLEANING COMPOSITION

(75) Inventors: Sergio Cardola, Rome (IT); Panos Iakovides, Rome (IT); Laura Orlandini, Bacoli (IT); Maria Rosa Rescio, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/700,068

(22) PCT Filed: May 13, 1999

(86) PCT No.: PCT/IB99/00864

§ 371 (c)(1),
(2), (4) Date: Dec. 20, 2000

(87) PCT Pub. No.: WO99/60086

PCT Pub. Date: Nov. 25, 1999

(30) Foreign Application Priority Data

May 15, 1998 (EP) ..... 98870110

(51) Int. Cl.[7] ..... C11D 1/14; C11D 3/28; C11D 3/22; C11D 3/43

(52) U.S. Cl. ..... 510/238; 510/199; 510/218; 510/245; 510/254; 510/274; 510/426; 510/434; 510/470; 510/473; 510/475; 510/499; 510/500

(58) Field of Search ..... 510/199, 218, 510/194, 245, 254, 274, 426, 434, 475, 470, 473, 499, 238, 500; 134/41, 42

(56) References Cited

U.S. PATENT DOCUMENTS

| | | | | | |
|---|---|---|---|---|---|
| 3,318,816 | A | | 5/1967 | Trowbridge | |
| 3,970,594 | A | * | 7/1976 | Claybaugh | 252/524 |
| 3,979,339 | A | * | 9/1976 | Claybaugh | 252/524 |
| 5,733,859 | A | * | 3/1998 | Carrie et al. | 510/362 |
| 6,140,293 | A | * | 10/2000 | Lappas | 510/305 |
| 6,281,718 | B1 | * | 8/2001 | Ryklin et al. | 510/181 |

FOREIGN PATENT DOCUMENTS

| | | |
|---|---|---|
| DE | 26 10 995 | 10/1976 |
| EP | 017 149 | 10/1980 |
| EP | 467 472 A2 | 1/1992 |
| EP | 496 188 A1 | 7/1992 |
| EP | 758 017 A1 | 2/1997 |
| EP | 919 610 A1 | 6/1999 |

* cited by examiner

*Primary Examiner*—Gregory Delcotto
(74) *Attorney, Agent, or Firm*—Jason J. Camp; Thibault Fayette; Kim William Zerby

(57) ABSTRACT

The present invention describes liquid acidic cleaning compositions suitable for cleaning bathroom surfaces comprising a homo- or copolymer or vinylpyrrolidone, or a mixture thereof, a polysaccharide polymer, or a mixture thereof, an anionic surfactant, and an acid. These compositions deliver improved shine to the treated surface as well as improved next-time cleaning benefit on said surface.

20 Claims, No Drawings

LIQUID ACIDIC HARD SURFACE CLEANING COMPOSITION

TECHNICAL FIELD

The present invention relates to liquid compositions for cleaning hard-surfaces.

BACKGROUND OF THE INVENTION

Liquid compositions for cleaning hard-surfaces have been disclosed in the art. Much of the focus for such compositions has been on providing outstanding cleaning on a variety of soils and surfaces. However, such compositions are not fully satisfactory from a consumer viewpoint especially regarding the soil release properties imparted to the hard-surfaces treated therewith. Indeed, consumers are looking for liquid cleaning compositions that would render a hard surface first treated therewith less prone to soil adherence and thus facilitate next-time (subsequent or secondary) cleaning operation.

Thus, the object of the present invention is to formulate a liquid cleaning composition for removal of various soils from hard-surfaces, especially hard-surfaces typically found in bathrooms, that will facilitate the next-time cleaning operation.

Also when formulating hard-surface cleaning compositions it is further desirable that these compositions efficiently remove limescale deposits and/or watermarks commonly found on bathroom hard-surfaces. Indeed, tap water contains a certain amount of solubilized ions which upon water evaporation eventually deposit as salts such as calcium carbonate on hard-surfaces which are often in contact with water, resulting in an anesthetic aspect of the surfaces. This limescale formation and deposition phenomenon is even more acute in places where water is particularly hard.

It is well-known in the art that limescale deposits can be chemically removed with acidic solutions.

Furthermore, it is also desirable that such liquid acidic compositions should have, in addition to the ability to effectively remove limescale deposits present on a surface, the ability to provide good shine to the surfaces treated. However, surface shine is often compromised because, when water comes in contact with hard-surfaces (e.g. in the rinse operation) it has the tendency to form droplets on the surface rather than forming a thin film uniformly spread over the surface or to run off the surface. This results, as water evaporates, in precipitation of poorly water soluble inorganic salts such as calcium/magnesium carbonate and/or phosphate salts with consequent formation of watermarks on the surface and, eventually limescale deposits, resulting in an anesthetic aspect of the surface.

It is thus a further object of the present invention to reduce the formation of watermarks and/or limescale deposits on a hard-surface that has been treated with a liquid acidic composition and hence to provide improved shine to this surface. More particularly, it is an object of the present invention to provide liquid acidic compositions delivering improved shine to the surface treated while exhibiting excellent limescale removing performance and facilitating the next time cleaning operation.

It has now been found that above objects are met by formulating a liquid composition, having an acidic pH, comprising a homo or copolymer of vinylpyrrolidone, together with a polysaccharide polymer, an anionic surfactant, and an acid.

In a preferred embodiment the homo or copolymer of vinylpyrrolidone is polyvinyl pyrrolidone and the polysaccharide polymer is xanthan gum.

In a preferred embodiment the composition further comprises a solvent.

It has now been found that improved next-time cleaning performance is obtained with the compositions according to the present invention on various types of stains/soils including greasy soap scum and other tough stains found in bathrooms.

An advantage of the liquid compositions of the present invention is that not only next-time cleaning performance is improved, but that also good first time cleaning performance is delivered.

Another unexpected finding associated to the compositions according to the present invention, is that they have the ability to provide good shine to the surface they have cleaned. Indeed, it has been found that the addition of a vinylpyrrolidone homopolymer or copolymer, together with a polysaccharide polymer, preferably xanthan gum, on top of an anionic surfactant, in a liquid acidic composition, reduces or even prevents the formation of watermarks and/or even limescale deposits on a surface having been treated with a composition of the present invention and later comes in contact with water, for example, during a rinse operation. Advantageously, the shine benefit delivered to the surface even persists after several cycles of rinsing, thus providing long lasting protection against formation of watermarks and/or even limescale deposits on the surface, and hence long lasting shiny surfaces.

Yet a further advantage of the compositions of the present invention is that faster drying is obtained on the surfaces that have been cleaned therewith. In other words, the housewife will have the advantage to shorten the total time of the cleaning operation of hard-surfaces and diminish the inconvenience of having wet surfaces in her home.

Also it has surprisingly been found that the compositions according to the present invention deliver the benefits mentioned herein (e.g., improved next-time cleaning, reduction and/or prevention of the formation of watermarks and/or even limescale deposits, resulting in good shine benefit and even long lasting shine benefit), when used to treat a variety of surfaces including metal surfaces such as aluminum, chromed steel, stainless steel, synthetic materials like vinyl, linoleum, glazed or non-glazed ceramic tiles, and/or enamel surfaces.

BACKGROUND ART

EP-A-0 017 149 discloses a liquid detergent composition comprising of a nonionic surfactant, a water-soluble nonionic, weak anionic or cationic polymer. An acidic composition comprising an anionic surfactant, a vinylpyrrolidone polymer together with a polysaccharide polymer is not disclosed.

EP-A-0 635 567 discloses a method of facilitating the removal of soil from a solid surface using a liquid composition comprising a material which is deposited on the surface during washing and upon drying forms a layer adhered to said surface, whereby the removal of soil contaminants from said surface is facilitated. Such materials are film-forming polymeric materials preferred polyvinyl pyrrolidone. An acidic composition comprising an anionic surfactant, a vinylpyrrolidone polymer together with a polysaccharide polymer is not disclosed.

EP-A-0 467 472 discloses a hard-surface modifying composition comprising an anti-soiling water-soluble anionic, cationic or nonionic polymer. Amongst the anti-soiling water-soluble anionic, cationic or nonionic polymer, polyvinyl pyrrolidone is disclosed. An acidic composition comprising an anionic surfactant, a vinylpyrrolidone polymer together with a polysaccharide polymer is not disclosed.

SUMMARY OF THE INVENTION

The present invention relates to a liquid acidic composition comprising (a) a homo or copolymer of vinylpyrrolidone, or a mixture thereof, (b) a polysaccharide polymer, or a mixture thereof, (c) an anionic surfactant, and (d) an acid.

In a preferred embodiment, a solvent is added to said composition.

The present invention also encompasses a process of treating hard-surfaces, preferably hard-surfaces located in bathrooms, wherein a liquid composition according to the present invention is applied onto said surfaces.

DETAILED DESCRIPTION OF THE INVENTION

The Liquid Hard-surface Cleaning Composition

The compositions according to the present invention are designed as hard-surfaces cleaners, preferred hard-surfaces treated therewith are those located in bathrooms.

The liquid compositions according to the present invention are preferably aqueous compositions. Therefore, they typically comprise from 70% to 99% by weight of the total composition of water, preferably from 75% to 95% and more preferably from 85% to 95%.

Acid

The liquid compositions of the present invention are acidic. Therefore they have a pH below 7, preferred from 0.5 to 6, preferred from 3 to 5, more preferred from 3 to 4.5. Thus, they comprise as a first essential ingredient an acid or a mixture thereof. Typically, the acids to be used herein may be any organic or inorganic acid well-known to those skilled in the art, or a mixture thereof.

Preferably, the organic acids for use herein have a pK of less than 7. Suitable organic acids for use herein, are those selected from the group consisting of citric acid, maleic acid, lactic acid, glycolic acid, succinic acid, glutaric acid and adipic acid, and mixtures thereof. A mixture of said acids suitable for use herein is commercially available from BASF under the trade name Sokalan® DCS. A preferred acid for use herein is citric acid.

Preferably, the inorganic acids for use herein have a pK of less than 3. Suitable inorganic acids for use herein, are those selected from the group consisting of sulphuric acid, chloridric acid, phosphoric acid, nitric acid, and mixtures thereof.

The amount of acid herein may vary depending on the amount of other ingredients, but suitable amounts of acids herein generally comprised between 0.5% and 10% by weight of the total composition, preferably between 1% and 8%, and most preferably between 2% and 6% particularly when citric acid is used.

Anionic Surfactant

The second essential ingredient is an anionic surfactant, or a mixture thereof. Anionic surfactants are used herein as they contribute to the cleaning benefits of the hard-surface cleaning compositions of the present invention. Indeed, the presence of an anionic surfactant contributes to the greasy soap scum cleaning of the compositions herein. More generally, the presence of an anionic surfactant in the liquid acidic compositions according to the present invention allows to lower the surface tension and to improve the wettability of the surfaces being treated with the liquid acidic compositions of the present invention. Furthermore, the anionic surfactant, or a mixture thereof, helps to solubilize the soils in the liquid acidic compositions of the present invention.

Typically, the compositions according to the present invention comprise from 0.1% to 20% by weight of the total composition of an anionic surfactant or a mixture thereof, more preferably from 1% to 10%, even more preferably from 1% to 7%, and most preferably from 1% to 5%.

Suitable anionic surfactants for use herein are all those commonly known by those skilled in the art. Preferably, the anionic surfactants for use herein include alkyl sulphonates, alkyl aryl sulphonates, alkyl sulphates, alkyl alkoxylated sulphates, $C_6$–$C_{20}$ alkyl alkoxylated linear or branched diphenyl oxide disulphonates, or mixtures thereof.

Suitable alkyl sulphonates for use herein include water-soluble salts or acids of the formula $RSO_3M$ wherein R is a $C_6$–$C_{20}$ linear or branched, saturated or unsaturated alkyl group, preferably a $C_8$–$C_{18}$ alkyl group and more preferably a $C_{10}$–$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$–$C_{20}$ linear or branched saturated or unsaturated alkyl group, preferably a $C_8$–$C_{18}$ alkyl group and more preferably a $C_{10}$–$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

By "secondary C6–C20 alkyl or C6–C20 alkyl aryl sulphonates", it is meant herein that in the formula as defined above, the SO3M or aryl-SO3M group is linked to a carbon atom of the alkyl chain being placed between two other carbons of the said alkyl chain (secondary carbon atom).

An example of a C14–C16 alkyl sulphonate is Hostapur® SAS available from Hoechst. An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

Suitable alkyl sulphate surfactants for use herein are according to the formula $R_1SO_4M$ wherein $R_1$ represents a hydrocarbon group selected from the group consisting of straight or branched alkyl radicals containing from 6 to 20 carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

By "linear alkyl sulphate or sulphonate" it is meant herein a non-substituted alkyl sulphate or sulphonate wherein the alkyl chain comprises from 6 to 20 carbon atoms, preferably from 8 to 18 carbon atoms, and more preferably from 10 to 16 carbon atoms, and wherein this alkyl chain is sulphated or sulphonated at one terminus.

By "branched sulphonate or sulphate", it is meant herein an alkyl chain having from 6 to 20 total carbon atoms, preferably from 8 to 18 total carbon atoms, and more preferably from 10 to 16 total carbon atoms, wherein the main alkyl chain is substituted by at least another alkyl chain, and wherein the alkyl chain is sulphated or sulphonated at one terminus.

Particularly preferred branched alkyl sulphates to be used herein are those containing from 10 to 14 total carbon atoms like Isalchem 123 AS®. Isalchem 123 AS® commercially available from Enichem is a C12–13 surfactant which is 94% branched. This material can be described as $CH_3$—$(CH_2)_m$—$CH(CH_2OSO_3Na)$—$(CH_2)_n$—$CH_3$ where n+m= 8–9. Also preferred alkyl sulphates are the alkyl sulphates where the alkyl chain comprises a total of 12 carbon atoms, i.e., sodium 2-butyl octyl sulphate. Such alkyl sulphate is commercially available from Condea under the trade name Isofol® 12S. Particularly suitable liner alkyl sulphonates include C12–C16 paraffin sulphonate like Hostapur® SAS commercially available from Hoechst.

Suitable alkyl alkoxylated sulphate surfactants for use herein are according to the formula $RO(A)_mSO3M$ wherein R is an unsubstituted $C_6$–$C_{20}$ alkyl or hydroxyalkyl group having a $C_6$–$C_{20}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$), $C_{12}$–$C_{18}$ alkyl polyethoxylate (2.25) sulfate, $C_{12}$–$C_{18}E(2.25)M$), $C_{12}$–$C_{18}$ alkyl polyethoxylate (3.0) sulfate $C_{12}$–$C_{18}E(3.0)$, and $C_{12}$–$C_{18}$ alkyl polyethoxylate (4.0) sulfate $C_{12}$–$C_{18}E(4.0)M$), wherein M is conveniently selected from sodium and potassium.

Suitable $C_6$–$C_{20}$ alkyl alkoxylated linear or branched diphenyl oxide disulphonate surfactants for use herein are according to the following formula:

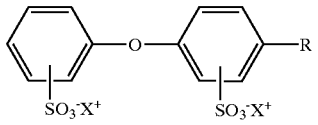

wherein R is a $C_6$–$C_{20}$ linear or branched, saturated or unsaturated alkyl group, preferably a $C_{12}$–$C_{18}$ alkyl group and more preferably a $C_{14}$–$C_{16}$ alkyl group, and X+ is H or a cation, e.g., an alkali metal cation (e.g., sodium, potassium, lithium, calcium, magnesium and the like). Particularly suitable $C_6$–$C_{20}$ alkyl alkoxylated linear or branched diphenyl oxide disulphonate surfactants to be used herein are the C12 branched di phenyl oxide disulphonic acid and C16 linear di phenyl oxide disulphonate sodium salt respectively commercially available by DOW under the trade name Dowfax 2A1® and Dowfax 8390®.

Other anionic surfactants useful herein include salts (including, for example, sodium, potassium, ammonium, and substituted ammonium salts such as mono-, di- and triethanolamine salts) of soap, $C_8$–$C_{24}$ olefinsulfonates, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_kCH_2COO$-M+wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Vinvlpyrrolidone Homopolymer or Copolymer

The liquid acidic compositions of the present invention comprise as a third essential ingredient a vinylpyrrolidone homopolymer or copolymer, or a mixture thereof. Typically, the compositions of the present invention comprise from 0.01% to 5% by weight of the total composition of a vinylpyrrolidone homopolymer or copolymer, or a mixture thereof, more preferably from 0.05% to 3% and most preferably from 0.05% to 1%.

Suitable vinylpyrrolidone homopolymers for use herein are homopolymers of N-vinylpyrrolidone having the following repeating monomer:

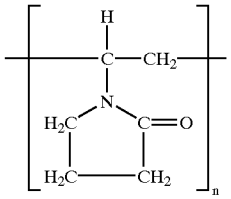

wherein n (degree of polymerisation) is an integer of from 10 to 1,000,000, preferably from 20 to 100,000, and more preferably from 20 to 10,000.

Accordingly, suitable vinylpyrrolidone homopolymers ("PVP") for use herein have an average molecular weight of from 1,000 to 100,000,000, preferably from 2,000 to 10,000,000, more preferably from 5,000 to 1,000,000, and most preferably from 50,000 to 500,000.

Suitable vinylpyrrolidone homopolymers are commercially available from ISP Corporation, New York, N.Y. and Montreal, Canada under the product names PVP K-15® (viscosity molecular weight of 10,000), PVP K-30® (average molecular weight of 40,000), PVP K60® (average molecular weight of 160,000), and PVP K-90® (average molecular weight of 360,000). Other suitable vinylpyrrolidone homopolymers which are commercially available from BASF Cooperation include Sokalan HP 165®, Sokalan HP 12®, Luviskol K30®, Luviskol K60®, Luviskol K80®, Luviskol K90®; vinylpyrrolidone homopolymers known to persons skilled in the detergent field (see for example EP-A-262,897 and EP-A-256,696).

Suitable copolymers of vinylpyrrolidone for use herein include copolymers of N-vinylpyrrolidone and alkylenically unsaturated monomers or mixtures thereof.

The alkylenically unsaturated monomers of the copolymers herein include unsaturated dicarboxylic acids such as maleic acid, chloromaleic acid, fumaric acid, itaconic acid, citraconic acid, phenylmaleic acid, aconitic acid, acrylic acid, N-vinylimidazole and vinyl acetate. Any of the anhydrides of the unsaturated acids may be employed, for example acrylate, methacrylate. Aromatic monomers like styrene, sulphonated styrene, alpha-methyl styrene, vinyl toluene, t-butyl styrene and similar well known monomers may be used.

The molecular weight of the copolymer of vinylpyrrolidone is not especially critical so long as the copolymer is water-soluble, has some surface activity and is adsorbed to the hard-surface from the liquid composition comprising it in such a manner as to increase the hydrophilicity of the surface. However, the preferred copolymers of N-vinylpyrrolidone and alkylenically unsaturated monomers or mixtures thereof, have a molecular weight of between 1,000 and 1,000,000, preferably between 10,000 and 500,000 and more preferably between 10,000 and 200,000.

For example particularly suitable N-vinylimidazole N-vinylpyrrolidone polymers for use herein have an average molecular weight range from 5,000 to 1,000,000, preferably from 5,000 to 500,000, and more preferably from 10,000 to 200,000. The average molecular weight range was determined by light scattering as described in Barth H. G. and Mays J. W. Chemical Analysis Vol 113, "Modern Methods of Polymer Characterization".

Such copolymers of N-vinylpyrrolidone and alkylenically unsaturated monomers like PVP/vinyl acetate copolymers are commercially available under the trade name Luviskol® series from BASF.

The copolymers of vinylpyrrolidone for use in the compositions of the present invention also include quaternized or unquaternized vinylpyrrolidone/dialkylaminoalkyl acrylate or methacrylate copolymers.

Such vinylpyrrolidone/dialkylaminoalkyl acrylate or methacrylate copolymers (quaternised or unquaternised) suitable to be used in the compositions of the present invention are according to the following formula:

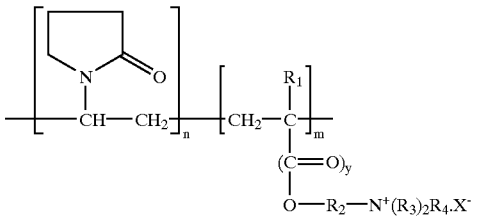

in which n is between 20 and 99 and preferably between 40 and 90 mol % and m is between 1 and 80 and preferably between 5 and 40 mol %; $R_1$ represents H or $CH_3$; y denotes 0 or 1; $R_2$ is —$CH_2$—CHOH—$CH_2$— or $C_xH_{2x}$, in which x=2 to 18; $R_3$ represents a lower alkyl group of from 1 to 4 carbon atoms, preferably methyl or ethyl, or

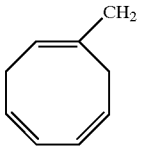

$R_4$ denotes a lower alkyl group of from 1 to 4 carbon atoms, preferably methyl or ethyl; $X^-$ is chosen from the group consisting of Cl, Br, I, $1/2SO_4$, $HSO_4$ and $CH_3SO_3$. The polymers can be prepared by the process described in French Pat. Nos. 2,077,143 and 2,393,573.

The preferred quaternized or unquaternized vinylpyrrolidone/dialkylaminoalkyl acrylate or methacrylate copolymers for use herein have a molecular weight of between 1,000 and 1,000,000, preferably between 10,000 and 500,000 and more preferably between 10,000 and 100,000.

Such vinylpyrrolidone/dialkylaminoalkyl acrylate or methacrylate copolymers are commercially available under the name copolymer 845®, Gafquat 734®, or Gafquat 755® from ISP Corporation, New York, N.Y. and Montreal, Canada or from BASF under the tradename Luviquat®.

Preferred third essential ingredient for use herein are the vinylpyrrolidone homopolymers.

Polysaccharide Polymer

The liquid acidic compositions of the present invention comprise as a fourth essential ingredient a polysaccharide polymer or a mixture thereof. Typically, the compositions of the present invention comprise from 0.01% to 5% by weight of the total composition of a polysaccharide polymer or a mixture thereof, more preferably from 0.05% to 3% and most preferably from 0.05% to 1%.

Suitable polysaccharide polymers for use herein include substituted cellulose materials like carboxymethylcellulose, ethyl cellulose, hydroxyethyl cellulose, hydroxypropyl cellulose, hydroxymethyl cellulose, succinoglycan and naturally occurring polysaccharide polymers like xanthan gum, guar gum, locust bean gum, tragacanth gum or derivatives thereof, or mixtures thereof.

Particularly polysaccharide polymers for use herein are xanthan gum and derivatives thereof. Xanthan gum and derivatives thereof may be commercially available for instance from Kelco under the trade name Keltrol RD®, Keizan S® or Kelzan T®. Other suitable Xanthan gum are commercially available by Rhone Poulenc under the trade name Rhodopol T® and Rhodigel X747®. Succinoglycan gum for use herein is commercially available by Rhone Poulenc under the trade name Rheozan®.

The compositions according to the present invention are advantageously chemically stable, i.e., there is virtually no chemical changes of the different ingredients due to reaction between them, and physically stable, i.e., that no phase separation occurs when stored in rapid aging test (RAT) at 50° C. for 10 days.

It has now surprisingly been found that the vinylpyrrolidone homopolymers or copolymers, preferably the vinylpyrrolidone homopolymer, and polysaccharide polymers, preferably xanthan gum or derivatives thereof, described herein, when added into a liquid acidic composition deliver improved shine to the treated surface as well as improved next-time cleaning benefit on said surface, while delivering good first-time hard-surface cleaning performance and good limescale removal performance.

Furthermore, it has surprisingly been found that the addition of an anionic surfactant on top of the combination of these polymers in a liquid acidic composition further enhances the improved shine benefit on the treated surface as well as the improved next-time cleaning benefit on said surface delivered by an acidic composition comprising the two polymers, as described herein in absence of the anionic surfactant.

The present invention is based on the finding that the vinylpyrrolidone homopolymers or copolymers and polysaccharide polymers present in the compositions of the present invention are able to modify the surface by depositing on the surface itself treated therewith. Although not wishing to be bound by theory, it has been observed that hard surfaces typically found in a household are neither highly hydrophobic nor highly hydrophilic. This means that, when water gets in contact with hard-surfaces, its spreading, which is controlled by the interfacial energy (i.e., solid/liquid surface tension), is very limited. Indeed, it has been observed that the most stable configuration for the water is grouping in spherical droplets rather than forming a thin film uniformly spread over the surface or than running off the surface. Then, as water droplets evaporate, their content of salt progressively becomes higher and higher so that carbonate salts eventually precipitate resulting in watermarks or even limescale deposits. The end result is a reduction of surface shine.

It has now been found that when the vinylpyrrolidone homopolymers or copolymers as described herein are added into liquid acidic compositions a hydrophilic layer is left on a hard-surface, like stainless steel, ceramic, porcelain, glass and the like, said hydrophilic layer leaves the water coming in contact with the surface having first been so treated (e.g., water which is used to rinse off the surfaces having been so treated) uniformly spread over the surface ("sheeting effect") instead of forming droplets. It has further been found that when the polysaccharide polymers as described herein are added into liquid acidic compositions containing the vinylpyrrolidone homopolymers or copolymers, the hydrophilic modification of the surface treated therewith is enhanced and the quality of said sheeting effect is magnified resulting in a much better shine benefit delivered to the treated surface. Furthermore, it has surprisingly been found that the presence of an anionic surfactant on top of these two polymers in an acidic composition results in an improved adsorption of the vinylpyrrolidone homopolymers or copolymers onto the treated hard-surfaces, like stainless steel, ceramic, porcelain, glass and the like, and therefore, further magnifies the sheeting effect, resulting in an even further improved shine benefit delivered to the treated surface. Thus by modifying the surface features as indicated, the formation of watermarks and/or limescale deposits upon drying is reduced or even eliminated.

Furthermore, it has surprisingly been found that the vinylpyrrolidone homopolymers or copolymers and polysaccharide polymers have not only the ability to adhere on a surface treated with the liquid acidic compositions of the present invention comprising the same, but to still remain adhered on the surface even after several cycles of rinsing (e.g., when water comes onto this surface later on for example in a sink during daily household operation), thus providing long lasting protection against formation of watermarks and/or deposition of limescale deposits, hence, long lasting shiny surfaces.

Additionally, the hydrophilic layer reduces adhesion of soils onto said hard-surface treated with the composition according to the present invention and/or facilitate removal of soils subsequently deposited thereon, i.e., less work (e.g. less scrubbing and/or less wiping and/or less chemical action) is required to remove the soils in the next-time cleaning operation, as compared to a similar soiled hard-surface which has been first treated with the same composition having both polymers of the present invention but without an anionic surfactant or the same composition having only one of said polymers in the presence of an anionic surfactant.

More particularly, it has surprisingly been found that there is a synergistic effect on next-time cleaning performance associated with the use of a vinylpyrrolidone homopolymer or copolymer and a polysaccharide polymer, as defined herein. Indeed, the next-time cleaning performance delivered by of a vinylpyrrolidone homopolymer or copolymer and a polysaccharide polymer, as defined herein, in a liquid composition, is superior than the next-time cleaning performance delivered by for example the same composition but comprising only one of those ingredients at the same total level of antiresoiling ingredients.

An additional advantage related to the use of the vinylpyrrolidone homopolymers or copolymers and polysaccharide polymers, in the acidic compositions herein, is that as they adhere on hard surface making them more hydrophilic, the surfaces themselves become smoother (this can be perceived by touching said surfaces) and this contribute to convey perception of surface perfectly descaled.

Advantageously, these benefits are obtained at low levels of vinylpyrrolidone homopolymers or copolymers and polysaccharide polymers, preferably xanthan gum or derivatives thereof, described herein, thus it is yet another advantage of the present invention to provide the desired benefits at low cost.

Optional Ingredients

The liquid compositions according to the present invention may comprise a variety of optional ingredients depending on the technical benefit aimed for and the surface treated.

Suitable optional ingredients for use herein include solvents, other surfactants, builders, chelants, buffers, bactericides, hydrotropes, colorants, stabilizers, radical scavengers, bleaches, bleach activators, suds controlling agents like fatty acids, enzymes, soil suspenders, dye transfer agents, brighteners, anti dusting agents, dispersants, dye transfer inhibitors, pigments, caustic, dyes and/or perfumes.

Solvent

The compositions of the present invention may further comprise a solvent or a mixture thereof, as a highly preferred optional ingredient. Solvents to be used herein include all those known to the those skilled in the art of hard-surfaces cleaner compositions.

Solvents are desired herein because they contribute to the greasy soap scum cleaning of the composition herein, they also improve the wettability of the surfaces being treated with said composition to maximize the polymers adsorption on the treated surface, with consequent improved sheeting effect and therefore even enhances the advantages of the present invention, described herein.

Suitable solvents for use herein include ethers and diethers having from 4 to 14 carbon atoms, preferably from 6 to 12 carbon atoms, and more preferably from 8 to 10 carbon atoms, glycols or alkoxylated glycols, alkoxylated aromatic alcohols, aromatic alcohols, aliphatic branched alcohols, alkoxylated aliphatic branched alcohols, alkoxylated linear C1–C5 alcohols, linear C1–C5 alcohols, C8–C14 alkyl and cycloalkyl hydrocarbons and halohydrocarbons, C6–C16 glycol ethers and mixtures thereof.

Suitable glycols to be used herein are according to the formula HO—CR1R2-OH wherein R1 and R2 are independently H or a C2–C10 saturated or unsaturated aliphatic hydrocarbon chain and/or cyclic. Suitable glycols to be used herein are dodecaneglycol and/or propanediol.

Suitable alkoxylated glycols to be used herein are according to the formula R—(A)n—R1-OH wherein R is H, OH, a linear saturated or unsaturated alkyl of from 1 to 20 carbon atoms, preferably from 2 to 15 and more preferably from 2 to 10, wherein R1 is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable alkoxylated aromatic alcohols to be used herein are according to the formula R $(A)_n$—OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic branched alcohols to be used herein are according to the formula R—OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols to be used herein are according to the formula R $(A)_n$—OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable alkoxylated linear C1–C5 alcohols to be used herein are according to the formula R $(A)_n$—OH wherein R is a linear saturated or unsaturated alkyl group of from 1 to 5 carbon atoms, preferably from 2 to 4, wherein A is an alkoxy group preferably butoxy, propoxy and/or ethoxy, and n is an integer of from 1 to 5, preferably 1 to 2. Suitable alkoxylated aliphatic linear C1–C5 alcohols are butoxy propoxy propanol (n-BPP), butoxyethanol, butoxypropanol, ethoxyethanol or mixtures thereof. Butoxy propoxy propanol is commercially available under the trade name n-BPP® from Dow chemical.

Suitable linear C1–C5 alcohols to be used herein are according to the formula R—OH wherein R is a linear saturated or unsaturated alkyl group of from 1 to 5 carbon atoms, preferably from 2 to 4. Suitable linear C1–C5 alcohols are methanol, ethanol, propanol or mixtures thereof.

Other suitable solvents include butyl diglycol ether (BDGE), butyltriglycol ether, ter amilic alcohol and the like. Particularly preferred solvents to be used herein are butoxy propoxy propanol, butyl diglycol ether, benzyl alcohol, butoxypropanol, ethanol, methanol, isopropanol and mixtures thereof.

The preferred solvent for use herein is butoxy propoxy propanol (n-BPP).

Typically, the compositions of the present invention comprise from 0.1% to 5% by weight of the total composition of a solvent or mixtures thereof, preferably from 0.5% to 5% by weight of the total composition and more preferably from 1% to 3% by weight of the total composition.

Additional Surfactant

The liquid compositions of the present invention preferably comprise an additional surfactant, or mixtures thereof, on top of the anionic surfactant already described herein. Additional surfactants may be desired herein as they further contribute to the cleaning performance and/or shine benefit of the compositions of the present invention. Surfactants to be used herein include nonionic surfactants, cationic surfactants, amphoteric surfactants, zwitterionic surfactants, and mixtures thereof.

Accordingly, the compositions according to the present invention may comprise up to 15% by weight of the total composition of another surfactant or a mixture thereof, on top of the anionic surfactant already described herein, more preferably from 0.5% to 5%, even more preferably from 0.5% to 3%, and most preferably 0.5% to 2%. Different surfactants may be used in the present invention including nonionic, cationic, zwitterionic or amphoteric surfactants. It is also possible to use mixtures of such surfactants without departing from the spirit of the present invention.

Preferred surfactants for use herein are zwitterionic surfactants. Indeed, they provide excellent grease soap scum cleaning ability to the compositions of the present invention.

Suitable zwitterionic surfactants for use herein contain both basic and acidic groups which form an inner salt giving both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylates and sulfonates, although other groups like sulfates, phosphonates, and the like can be used.

A generic formula for preferred zwitterionic surfactants for use herein (i.e., betaine and/or sulfobetaine) is:

$$R_1—N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is a carboxylate or sulfonate group, preferably sulfonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a—C(O)—NR_b—(C(R_c)_2)_m$, wherein $R_a$ is an aliphatic or aromatic, saturated or unsaturated, substituted or unsubstituted hydrocarbon chain containing from 8 up to 20 carbon atoms, preferably an alkyl group containing from 8 up to 20 carbon atoms, preferably up to 18, more preferably up to 16, $R_b$ is either a hydrogen a short chain alkyl or substituted alkyl containing from 1 to 4 carbon atoms, preferably a group selected from the group consisting of methyl, ethyl, propyl, hydroxy substituted ethyl or propyl and mixtures thereof, more preferably methyl or hydrogen, $R_c$ is selected from the group consisting of hydrogen and hydroxy groups, and m is from 1 to 4, preferably from 2 to 3, more preferably 3, with no more than one hydroxy group in any $(C(R_c)_2)$ moiety.

Preferred $R_2$ is hydrogen, or an alkyl or substituted alkyl containing from 1 to 4 carbon atoms, preferably a group selected from the group consisting of methyl, ethyl, propyl, hydroxy substituted ethyl or propyl and mixtures thereof, more preferably methyl. Preferred $R_3$ is a $C_1$–$C_4$ carboxylic acid group, a C1–C4 sulfonate group, or an alkyl or substituted alkyl containing from 1 to 4 carbon atoms, preferably a group selected from the group consisting of methyl, ethyl, propyl, hydroxy substituted ethyl or propyl and mixtures thereof, more preferably methyl. Preferred $R_4$ is $(CH2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N, N-dimethylammonia)acetate, 2-(N-coco N, N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

A further example of betaine is Lauryl-imminodipropionate commercially available from Rhone-Poulenc under the trade name Mirataine H2C-HA®.

Particularly preferred zwitterionic surfactants for use in the acidic compositions of the present invention are the sulfobetaine surfactants as they deliver optimum soap scum cleaning benefits.

Examples of particularly suitable sulfobetaine surfactants include tallow bis(hydroxyethyl) sulphobetaine, cocoamido propyl hydroxy sulfobetaines which are commercially available from Rhone Poulenc and Witco, under the trade name of Mirataine CBS® and Rewoteric AM CAS 15® respectively.

Further examples of amidobetaines/amidosulfobetaine include cocoamidoethylbetaine, cocoamidopropyl betaine or C10–C14 fatty acylamidopropylene(hydropropylene) sulfobetaine. For example C10–C14 fatty acylamidopropylene(hydropropylene)sulfobetaine is commercially available from Sherex Company under the trade name "Varion CAS® sulfobetaine".

Suitable amines for use herein are according to the following formula RR'R"N wherein R is a saturated or unsaturated, substituted or unsubstituted, linear or branched alkyl groups containing from 1 to 30 carbon atoms, and preferably from 1 to 20 carbon atoms and wherein R' and R" are independently saturated or unsaturated, substituted or unsubstituted, linear or branched alkyl groups containing from 1 to 30 carbon atoms or hydrogen. Particularly preferred amines to be used according to the present invention are amines having the following formula RR'R" N wherein R is a saturated or unsaturated, linear or branched alkyl group containing from 1 to 30 carbon atoms, preferably from 8 to 20 carbon atoms, more preferably from 6 to 16, most preferably from 8 to 14 and wherein R' and R" are independently substituted or unsubstituted, linear or branched alkyl groups containing from 1 to 4 carbon atoms, preferably from 1 to 3 carbon atoms, and more preferably are methyl groups, or mixtures thereof.

Suitable amines for use herein are for instance C12 dimethyl amine, coconut dimethyl amine, C12–C16 dimethyl amine. Said amines may be commercially available from Hoechst under the trade name Genamin®, AKZO under the trade name Aromox® or Fina under the trade name Radiamine®.

Suitable quaternary ammonium surfactants for use herein are according to the formula $R_1R_2R_3R_4N^+X^-$, wherein X is a counteranion such as halogen, methyl sulphate, methyl sulphonate, or hydroxide, $R_1$ is a saturated or unsaturated, substituted or unsubstituted, linear or branched alkyl group containing from 1 to 30 carbon atoms, preferably from 12 to 20, more preferably from 8 to 20 and $R_2$, $R_3$ and $R_4$ are independently hydrogen, or saturated or unsaturated, substituted or unsubstituted, linear or branched alkyl groups containing from 1 to 4 carbon atoms, preferably from 1 to 3 and more preferably methyl. In highly preferred quaternary ammonium surfactants herein $R_1$ is a $C_{10}$–$C_{18}$ hydrocarbon chain, most preferably $C_{12}$, $C_{14}$, or $C_{16}$, and $R_2$, $R_3$ and $R_4$ are all three methyl, and X is halogen, preferably bromide or chloride, most preferably bromide.

Examples of quaternary ammonium surfactants are myristyl trimethylammonium methyl sulphate, cetyl trimethylammonium methyl sulphate, lauryl trimethyl ammonium bromide, stearyl trimethyl ammonium bromide (STAB), cetyl trimethyl ammonium bromide (CTAB) and myristyl trimethyl ammonium bromide (MTAB). Highly preferred herein are lauryl trimethyl ammonium salts. Such trimethyl quaternary ammonium surfactants may be commercially available from Hoechst, or from Albright & Wilson under the trade name Empigen CM®.

Suitable nonionic surfactants for use herein are alkoxylated alcohol nonionic surfactants which can be readily made by condensation processes which are well-known in the art. However, a great variety of such alkoxylated alcohols, especially ethoxylated and/or propoxylated alcohols is also conveniently commercially available. Surfactants catalogs are available which list a number of surfactants, including nonionics.

Accordingly, preferred alkoxylated alcohols for use herein are nonionic surfactants according to the formula RO(E)e(P)pH where R is a hydrocarbon chain of from 2 to 24 carbon atoms, e is ethylene oxide and p is propylene oxide, and e and p which represent the average degree of, respectively ethoxylation and propoxylation, are of from 0 to 24. The hydrophobic moiety of the nonionic compound can be a primary or secondary, straight or branched alcohol having from 8 to 24 carbon atoms. Preferred nonionic surfactants for use in the compositions according to the invention are the condensation products of ethylene oxide with alcohols having a straight alkyl chain, having from 6 to 22 carbon atoms, wherein the degree of ethoxylation is from 1 to 15, preferably from 5 to 12. Such suitable nonionic surfactants are commercially available from Shell, for instance, under the trade name Dobanol® or from BASF under the trade name Lutensol®.

Amphoteric and ampholytic detergents which can be either cationic or anionic depending upon the pH of the system are represented by detergents such as dodecylbetaalanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378, said patents being incorporated herein by reference. Additional synthetic detergents and listings of their commercial sources can be found in McCutcheon'ss Detergents and Emulsifiers, North American Ed. 1980, incorporated herein by reference.

Suitable amphoteric surfactants include the amine oxides corresponding to the formula:

$$R\ R'R''N\rightarrow O$$

wherein R is a primary alkyl group containing 6–24 carbons, preferably 10–18 carbons, and wherein R' and R" are, each, independently, an alkyl group containing 1 to 6 carbon atoms. The arrow in the formula is a conventional representation of a semi-polar bond. The preferred amine oxides are those in which the primary alkyl group has a straight chain in at least most of the molecules, generally at least 70%, preferably at least 90% of the molecules, and the amine oxides which are especially preferred are those in which R contains 10–18 carbons and R' and R" are both methyl. Exemplary of the preferred amine oxides are the N-hexyldimethylamine oxide, N-octyldimethylamine oxide, N-decyidimethylamine oxide, N-dodecyl dimethylamine oxide, N-tetradecyidimethylamine oxide, N-hexadecyl dimethylamine oxide, N-octadecyldimethylamine oxide, N-eicosyldimethylamine oxide, N-docosyldimethylamine oxide, N-tetracosyl dimethylamine oxide, the corresponding amine oxides in which one or both of the methyl groups are replaced with ethyl or 2-hydroxyethyl groups and mixtures thereof. A most preferred amine oxide for use herein is N-decyldimethylamine oxide.

Suitable amine oxides for use herein are for instance coconut dimethyl amine oxides, C12–C16 dimethyl amine oxides. Said amine oxides may be commercially available from Hoechst, Stephan, AKZO (under the trade name Aromox®or FINA (under the trade name Radiamox®).

Other suitable amphoteric surfactants for the purpose of the invention are the phosphine or sulfoxide surfactants of formula:

$$R\ R'R''A\rightarrow O$$

wherein A is phosphorus or sulfur atom, R is a primary alkyl group containing 6–24 carbons, preferably 10–18 carbons, and wherein R' and R" are, each, independently selected from methyl, ethyl and 2-hydroxyethyl. The arrow in the formula is a conventional representation of a semi-polar bond.

Cationic surfactants suitable for use in compositions of the present invention are those having a long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from 8 to 18 carbon atoms in the alkyl chain, each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, $—CH_2CHOH—CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980, incorporated herein by reference.

Dye

The liquid compositions according to the present invention may be coloured. Accordingly, they may comprise a dye or a mixture thereof. Suitable dyes for use herein are acid-stable dyes. By "acid-stable", it is meant herein a compound which is chemically and physically stable in the acidic environment of the compositions herein.

Caustic

In order to maintain the pH of the composition herein disclosed, the composition may further comprise a caustic or a mixture thereof, as an optional ingredient. Caustic to be used herein include all those known to the those skilled in the art of hard-surfaces cleaner compositions, as hydroxides of metals, ammonia, and the like. A preferred caustic is NaOH.

Radical Scavenger

The compositions of the present invention may comprise a radical scavenger or a mixture thereof.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers when used, are typically present herein in amounts up to 10% by weight of the total composition and preferably from 0.001% to 0.5% by weight.

The presence of radical scavengers may contribute to the chemical stability of the acidic compositions of the present invention.

Perfume

Suitable perfumes for use herein include materials which provide an olfactory aesthetic benefit and/or cover any "chemical" odour that the product may have. The main function of a small fraction of the highly volatile, low boiling (having low boiling points), perfume components in these perfumes is to improve the fragrance odour of the product itself, rather than impacting on the subsequent odour of the surface being cleaned. However, some of the less volatile, high boiling perfume ingredients provide a fresh and clean impression to the surfaces, and it is desirable that these ingredients be deposited and present on the dry surface. Perfume ingredients can be readily solubilized in the compositions, for instance by the anionic detergent surfactants. The perfume ingredients and compositions suitable to be used herein are the conventional ones known in the art. Selection of any perfume component, or amount of perfume, is based solely on aesthetic considerations.

Suitable perfume compounds and compositions can be found in the art including U.S. Pat. Nos. : 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. In general, the degree of substantivity of a perfume is roughly proportional to the percentages of substantive perfume material used. Relatively substantive perfumes contain at least about 1%, preferably at least about 10%, substantive perfume materials. Substantive perfume materials are those odorous compounds that deposit on surfaces via the cleaning process and are detectable by people with normal olfactory acuity. Such materials typically have vapour pressures lower than that of the average perfume material. Also, they typically have molecular weights of about 200 and above, and are detectable at levels below those of the average perfume material. Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, ciscitral (neral), citronellal, citronellol, citronellyl acetate, para-cymene, decanal, dihydrolinalool, dihydromyrcenol, dimethyl phenyl carbinol, eucaliptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, mycrene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, and veratraldehyde. Cedarwood terpenes are composed mainly of alpha-cedrene, beta-cedrene, and other C15H24 sesquiterpenes. Examples of the less volatile, high boiling, perfume ingredients are benzophenone, benzyl salicylate, ethylene brassylate, galaxolide (1,3,4,6,7,8-hexahydro-4,6,6,7,8,8-hexamethyl-cyclopenta-gama-2-benzopyran), hexyl cinnamic aldehyde, lyral (4-(4-hydroxy-4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Selection of any particular perfume ingredient is primarily dictated by aesthetic considerations.

The compositions herein may comprise a perfume ingredient, or mixtures thereof, in amounts up to 5.0% by weight of the total composition, preferably in amounts of 0.1% to 1.5%.

Chelating Agent

Another class of optional compounds for use herein include chelating agents or mixtures thereof. Chelating agents can be incorporated in the compositions herein in amounts ranging from 0.0% to 10.0% by weight of the total composition, preferably 0.01% to 5.0%.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'- disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

The Process of Treating a Hard-Surface

The present invention also encompasses a process of treating a hard-surface wherein a liquid acidic composition as described herein is contacted with a hard-surface.

By "hard-surfaces" it is meant herein any kind of surfaces typically found in houses like bathrooms, kitchens, or in car interiors or exteriors, e.g., floors, walls, tiles, windows, sinks, showers, shower plastified curtains, wash basins, WCs, dishes, fixtures and fittings and the like made of different materials like ceramic, vinyl, no-wax vinyl, linoleum, melamine, glass, any plastics, plastified wood, metal or any painted or varnished or sealed surface and the like. Hard-surfaces also include household appliances including, but not limited to, washing machines, automatic dryers, refrigerators, freezers, ovens, microwave ovens, dishwashers and so on.

The preferred process of treating a hard-surface, is to apply the composition described by the present invention, leave it on said surface to act, optionally wipe said surface with an appropriate instrument, e.g. a sponge, and then preferably rinse said surface with water.

The liquid compositions of the present invention may be contacted to the surface to be treated in its neat form or in its diluted form. Preferably, the composition is applied in its neat form.

By "sdiluted form", it is meant herein that said liquid composition is diluted by the user typically with water. The composition is diluted prior use to a typical dilution level of 10 to 400 times its weight of water, preferably from 10 to 200 and more preferably from 10 to 100. Usual recommended dilution level is a 1.2% dilution of the composition in water.

The compositions according to the present invention are particularly suitable for treating hard-surfaces located in bathrooms. These bathroom surfaces may be soiled by the so called "limescale-containing stains". By "limescale-containing stains" it is meant herein any pure limescale stains, i.e., any stains composed essentially of mineral deposits, as well as limescale-containing stains, i.e., stains which contain not only mineral deposits like calcium and/or magnesium carbonate but also soap scum (e.g., calcium stearate) and other grease (e.g. body grease). Actually, the compositions of the present invention exhibit excellent limescale removing performance when used to treat any types of surfaces soiled by limescale-containing stains comprising not only pure limescale deposits but also at least 10% by weight of the total stain of organic deposits like soap scum and grease, preferably more than 30%.

By "treating" it is meant herein, cleaning, as the composition according to the present invention provides excellent first-time and next-time cleaning performance on various stains, especially greasy soup scum, as well as descaling, as the composition according to the present invention provides excellent limescale removal performance on limescale-containing stains.

Greasy Soap Scum Cleaning Performance Test Method

In this test method enamel white tiles (typically 24 cm*4 cm) are covered with typical greasy soap scum soils mainly based on calcium stearate and artificial body soils commercially available (e.g. 0.3 grams with a sprayer). The soiled tiles are then dried in an oven at a temperature of 140° C. for 20 minutes and then aged overnight at room temperature (around 20° C.–25° C.). Then the soiled tiles are cleaned using 3 ml of the liquid acidic composition of the present invention poured directly on a Spontex® sponge. The ability of the composition to remove greasy soap scum is measured through the number of strokes needed to perfectly clean the surface. The lower the number of strokes, the higher the greasy soap scum cleaning ability of the composition.

Next Time-cleaning Benefit Test Method

In this test method stainless steel tap or black ceramic are treated with the liquid acidic composition of the present invention by directly pouring said composition on a Spontex® sponge and rubbing said tiles with said sponge. Then the tiles are being thoroughly rinsed with tap water and let to dry. Soapy water (about 100 ml) is splashed on the dry surface and rinsed with running tap water (about 100 ml). The surface of the tiles are again let to dry and the procedure of splashing soapy water on said tiles is repeated for 4–6 times.

The ability of a composition to provide next time-cleaning benefit to the surface refers to the composition'ss ability to modify the surface in such a way, that the soapy water is rinsed away more easily on surfaces treated with the liquid acidic composition of the present invention compared to surfaces not treated with said composition. This can be evaluated by human visual grading.

Limescale Removal Performance Test Method

The limescale removal capacity of a composition according to the present invention may be evaluated by soaking a marble block (marble blocks are chemically speaking very similar to limescale, i.e., they are essentially made of calcium carbonate) into 20 g of this composition. The marble is weighed before and after the experiment, and the performance is expressed in grams of marble block dissolved over time. Alternatively, limescale removing performance can also be evaluated by detecting the release of $CO_2$.

Shine Test Method

Obtaining a good shine end result results from a good spreading of a liquid composition over the surface when the surface is treated therewith and from the reduced formation of watermarks and reduced precipitation of poorly water soluble salts when water evaporates. The ability of a composition to provide "shine" to the surface refers to the composition'ss ability to leave no watermarks after evaporation of water. This can be evaluated by human visual grading.

In a suitable test method a composition according to the present invention and a reference composition are applied (about 3 grams of each product) with a Spontex® sponge on two rectangular areas (20 cm×20 cm) of a surface made of stainless made of steel or ceramic. Each surface is wiped ( 16 strokes) by using the Spontex® sponge with the product. Then each treated surface is rinsed with 50 ml of tap water and left to dry. Items are observed during the drying phase in a way to evaluate water spreading/slipping on the treated surface. After the surfaces treated with the compositions according to the present invention and those treated with the reference composition get dried, they are compared side by side and evaluated by visual grading to evaluate shine difference. Evaluation may be generally done by applying the Panel Score Unit (PSU). Shine result is expressed reporting whether the effect of water spreading/slipping is present and the final PSU evaluation.

In a long lasting shine test method, the test method as mentioned above may be carried out, but the rinsing and drying cycles are repeated several times. Each time, after both the surfaces get dried they are compared side by side and evaluated by visual grading to see shine difference. Evaluation is generally done by applying the Panel Score Unit (PSU).

EXAMPLES

These compositions were made comprising the listed ingredients in the listed proportions (weight %).

| Ingredients: | I | II | III | IV | V | VI | VII |
|---|---|---|---|---|---|---|---|
| (% by weight) | | | | | | | |
| Chloridric acid | — | — | — | — | — | — | 2.0 |
| Isalchem 123 AS ® | 1.3 | 1.5 | 1.5 | 3.5 | 3.5 | 10.0 | 1.3 |
| n-BPP | 2.0 | 2.0 | 2.0 | — | 2.0 | 2.0 | 2.0 |
| Citric Acid | 3.5 | 3.5 | 3.0 | 3.5 | 3.5 | 3.5 | — |
| Luviskol K60 ® | 0.1 | 0.1 | 0.05 | 0.05 | 0.1 | 0.1 | 0.1 |
| Kelzan T ® | 0.3 | 0.3 | 0.2 | 0.3 | 0.3 | 0.3 | 0.3 |
| NaOH | — | — | — | — | 0.75 | — | — |
| Waters & Minors | | | | up to 100 | | | |

The pH of these examples is below 7.

| Ingredients: | VII | IX | X | XI | XII | XIII | XIV |
|---|---|---|---|---|---|---|---|
| (% by weight) | | | | | | | |
| Chloridric acid | — | — | — | — | — | — | 2.0 |
| C1O AS | 1.3 | 1.5 | 1.75 | 3.5 | 3.5 | 10.0 | 1.3 |
| n-BPP | 2.0 | 2.0 | 2.0 | — | 2.0 | 2.0 | 2.0 |
| Citric Acid | 3.5 | 3.5 | 3.0 | 3.5 | 3.5 | 3.5 | — |
| Luviskol K60 ® | 0.1 | 0.1 | 0.1 | 0.05 | 0.1 | 0.1 | 0.1 |
| Kelzan T ® | 0.3 | 0.3 | 0.25 | 0.3 | 0.3 | 0.3 | 0.3 |
| NaOH | — | — | 0.25 | — | — | — | — |
| Waters & Minors | | | | up to 100 | | | |

The pH of these examples is below 7.

Keizan T® is a Xanthan gum supplied by Kelco.

Luviskol K60® is a Polyvinylpyrrolidone supplied by BASF.

Isalchem 123 AS® is a branched alcohol alkyl sulphate commercially available from Enichem.

C10-AS is linear C10-alkyl sulphate.

n-BPP is butoxy propoxy propanol.

What is claimed is:

1. A liquid acidic cleaning composition having a pH from 3 to 6, comprising from about 0.01% to about 5% by weight of a) homo or copolymer of vinylpyrrolidone, or a mixture thereof, b) a polysaccharide polymer, or a mixture thereof, c) an anionic surfactant, and d) an acid selected from the group consisting of citric acid, maleic acid, lactic acid, glycolic acid, succinic acid, glutaric acid, adipic acid, sulphuric acid, hydrochloric acid, phosphoric acid, nitric acid, and mixtures thereof.

2. A composition according to claim 1 wherein the composition comprises from about 0.5% to about 10% by weight of the total composition of the acid.

3. A composition according to claim 1 wherein said vinylpyrrolidone homopolymer is a homopolymer of N-vinylpyrrolidone having the following repeating monomer:

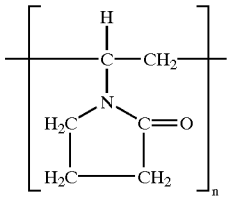

wherein n is an integer of from about 10 to about 1,000,000.

4. A liquid acidic cleaning composition having a pH from 3 to 6, comprising: from about 0.01% to about 5% by weight of a) a copolymer of n-vinylpyrrolidone and an alkylenically unsaturated monomer;

b) a polysaccharide polymer, or mixture thereof;

c) an anionic surfactant, and d) an acid selected from the group consisting of citric acid, maleic acid, lactic acid, glycolic acid, succinic acid, glutaric acid, adipic acid, sulphuric acid, hydrochloric acid, phosphoric acid, nitric acid, and mixtures thereof.

5. A composition according to claim 4 wherein said alkylenically unsaturated monomer is selected from the group consisting of maleic acid, chloromaleic acid, fumaric acid, itaconic acid, citraconic acid, phenylmaleic acid, aconitic acid, acrylic acid, N-vinylimidazole, vinyl acetate, and anhydrides thereof, styrene, sulphonated styrene, alphamethyl styrene, vinyl toluene, t-butyl styrene and mixtures thereof.

6. A liquid acidic cleaning composition having a pH from 3 to 6, comprising: from about 0.01% to about 5% by weight of a) from about 0.01% to about 5% by weight of a quaternized vinylpyrrolidone/dialkylaminoalkyl acrylate or methacrylate copolymer according to the following formula:

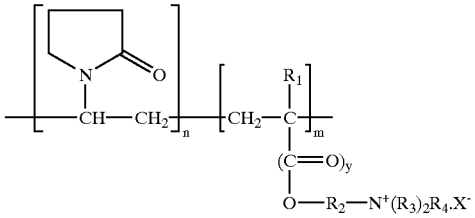

in which n is between about 20 and about 99 mol % and m is between about 1 and about 80 mol %; R1 represents H or CH3; y denotes 0 or 1; R2 is —CH2—CHOH—CH2— or CxH2x, in which x=2 to 18; R3 represents a lower alkyl group of from 1 to 4 carbon atoms, or

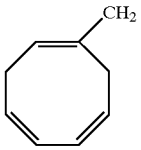

R4 denotes a lower alkyl group of from 1 to 4 carbon atoms; X— is chosen from the group consisting of Cl, Br, I, 1/2SO4, HSO4 and CH3SO3;

b) from about 0.0% to about 5% by weight of a polysaccharide polymer, or mixture thereof;

c) an anionic surfactant; and d) an acid selected from the group consisting of citric acid, maleic acid, lactic acid, glycolic acid, succinic acid, glutaric acid, adipic acid, sulphuric acid, hydrochloric acid, phosphoric acid, nitric acid, and mixtures thereof.

7. A composition according to claim 1 wherein said polysaccharide polymer is a substituted cellulose material or a naturally occurring polysaccharide polymer or a mixture thereof.

8. A composition according to claim 1 wherein said polysaccharide polymer is carboxymethylcellulose, ethyl cellulose, hydroxyethyl cellulose, hydroxypropyl cellulose, hydroxymethyl cellulose, succinoglycan, xanthangum, guar gum, locust bean gum, tragacanth gum or derivatives thereof, or mixtures thereof.

9. A composition according to claim 1 wherein said anionic surfactant is selected from the group consisting of alkyl sulphonates, alkyl aryl sulphonates, alkyl sulphates, alkyl alkoxylated sulphates, $C_6$–$C_{20}$ alkyl alkoxylated linear or branched diphenyl oxide disulphonates, and a mixture thereof.

10. A composition according to claim 1, wherein said anionic surfactant is an alkyl sulphate surfactant according to the formula $R_1SO_4M$ wherein $R_1$ represents a hydrocarbon group selected from the group consisting of straight or branched alkyl radicals containing from about 6 to about 20 carbon atoms and wherein M is H or a cation.

11. A composition according to claim 1 wherein the composition comprises from about 0.1% to about 20% by weight of the total composition of an anionic surfactant.

12. A composition according to claim 1 which further comprises a solvent.

13. A composition according to claim 12 wherein said solvent is an organic solvent selected the group consisting of ethers and diethers having from about 4 to about 14 carbon atoms, glycols and alkoxylated glycols, alkoxylated aromatic alcohols, aromatic alcohols, aliphatic branched alcohols, alkoxylated aliphatic branched alcohols, alkoxylated linear C1–C5 alcohols, linear C1–C5 alcohols, C8–C14 alkyl and cycloalkyl hydrocarbons and halohydrocarbons, C6–C16 glycol ethers, and mixtures thereof.

14. A composition according to claim 12 wherein said composition comprises from about 0.1% to about 5% by weight of the total composition of said solvent.

15. A composition according to claim 1 wherein said composition further comprises one or more ingredients selected from the group consisting of nonionic surfactants, cationic surfactants, amphoteric surfactants, zwitterionic surfactants, radical scavengers, chelating agents, caustics, perfumes, and dyes, and mixtures thereof.

16. A process of treating a hard-surface by applying a liquid composition according to claim 1 onto said surface.

17. A process according to claim 16 whereby said hard-surface is located in a bathroom.

18. Method for improving the shine of a hard-surface and/or for delivering long lasting shine to a hard-surface by treating said hard-surface with an acidic composition according to claim 4.

19. Method for reducing the formation of limescale deposits and/or watermarks on a hard-surface when it comes in contact with water by treating said hard-surface with an acidic composition according to claim 4.

20. Method for improving the next-time cleaning performance on a hard-surface by treating said hard surface with an acidic composition according to claim 6.

* * * * *